US007065810B2

(12) United States Patent
Robinson

(10) Patent No.: US 7,065,810 B2
(45) Date of Patent: Jun. 27, 2006

(54) REVERSIBLE BLANKET (WITH ATTACHED PANTS)

(76) Inventor: Barbara A. Robinson, P.O. Box 16091, Des Moines, IA (US) 50316

( * ) Notice: Subject to any disclaimer, the term of this patent is extended or adjusted under 35 U.S.C. 154(b) by 11 days.

(21) Appl. No.: 10/910,519

(22) Filed: Aug. 3, 2004

(65) Prior Publication Data

US 2006/0026760 A1 Feb. 9, 2006

(51) Int. Cl.
*A47G 9/00* (2006.01)

(52) U.S. Cl. ..... 5/494

(58) Field of Classification Search ..... 5/494, 5/495

See application file for complete search history.

(56) References Cited

U.S. PATENT DOCUMENTS 2,989,753 A * 6/1961 Burner ..... 2/69.5
4,172,300 A * 10/1979 Miller ..... 5/494
4,597,121 A * 7/1986 Bouma ..... 5/494
6,145,932 A * 11/2000 Hamel-Nyhus et al. ..... 5/494

OTHER PUBLICATIONS

Declaration of Barbara A. Robinson to Accompany Information Disclosure Statement.

* cited by examiner

*Primary Examiner*—Frederick L. Lagman
(74) *Attorney, Agent, or Firm*—McKee, Voorhees & Sease, P.L.C.

(57) ABSTRACT

A reversible blanket (with attached pants) can be made of fleece, terry towel, or any material that is comfortable to the touch. The reversible blanket (with attached pants) is shaped like a flat baby blanket with hole in the middle with a pair of pants attached. The pants are permanent attached to the hole in the middle of the blanket. The pants acts like a sack with legs, which the baby/child/adult can be, place inside. The blanket is reversible and can be designed with/without detachable booties/feet. Only the detachable booties/feet are not reversible, the rest of the blanket is reversible. The reversible blanket (with attached pants) is designed for easy access "just put baby/child/adult inside the pants and you're ready to go. Reverse the blanket by simply turning inside out. Measurements referred to are comprisable to an infant child.

4 Claims, 4 Drawing Sheets

REVERSIBLE BLANKET (WITH ATTACHED PANTS)

FIELD OF THE INVENTION

The invention relates to blankets. Most generally to infant blankets and the typical problem of putting the wrapped up infant into the typical seating device such as infant carrier, car seat, stroller, swing, etc. and which facilitates the covering of the infant's feet and head at the same time, and dealing with the infant soiling the blanket before accomplishing this.

BACKGROUND AND SUMMARY OF THE INVENTION

Baby blankets and coverings are well known and since baby blankets are intended, foremost, to keep an infant's body warm, it is my objective to develop a blanket which will make it easy to keep infant warm, eliminate the second blanket, to eliminate not enough blanket, eliminate the ("I lost one of her shoes".)

There are many blankets out there, but not one supplies the needs like this blanket does. This blanket does not cover the car seat, etc. it is not a safety device, the reversible blanket (with attached pants) covers the torso. The fleece is next to the skin or the garment the infant is wearing.

Every new mom worries about whether or not the baby is warm enough. Working child care and being a grandmother it has come to my attention the needs that would make it easier on the child's provider. My invention will work with all the other inventions geared towards the warming and the convenience of coverings. This blanket is durable and can be produced from any fabric/material which is comfortable to the touch and appropriate for the weather. This blanket is reversible giving you actually two blankets (one side for an emergency use). You also get two panels of fleece verses one panel. The addition of the pants to the blanket adds to the use of the blanket portion. Because now the bottom torso is sit into the actual pair of pants (fleece) that is connected to the opening in the middle of the blanket. Leaving the upper portion of the blanket available to cover the upper torso. *Imagine holding your 5 mth old on your hip at church, it cool in the church, you put the infant's torso inside the pants portion (fully clothed with shoes and all still on) quite comfortable. Infant's legs and bottom is covered and no loss of shoes or socks will occur the blanket is available for you to wrap or leave hanging on you arms. It will never drop off on the floor.

Once the infant is inside the reversible blanket (with attached pants) (infant can be either dressed for inside or outside it does not matter) it's endless what you can do. At home snuggling, laying the bassinet, breast feeding in comfort (home or away) with no extra blanket. It is easy and accessible because of the legs/pants (couch); car seat, swing, stroller, etc. Easy access to straps, restraints, etc. What could be more snug than the reversible blanket (with attached pants) inside of the infant carrier.

This opens the doors to more designer blankets for the infant and new mothers. Caution should be used when designing: using only safe fabrics (approved fleece, cotton, polyester), using only attachments that are approved and not harmful to the infant making sure that everything is snuggly attached.

My invention (The reversible blanket (with attached pants) is intended to better utilize the common blanket. It's intent is to change the look and accessibility of the common blanket. To give mom helping hand by eliminating the second blanket. All normal cautions still should be exercised while using this blanket. The legs/pants portion gives a better use of the blanket portion to the upper torso.

BRIEF DESCRIPTION OF THE DRAWING

These and other features of the invention will be described by the reference to the drawings of one embodiment of the present covering for the reversible blanket (with attached pants), which are intended to illustrate, but not to limit, the invention. The drawing contain the following figures:

FIG. 3C for detachable booties/feet use pattern or cut from scratch. When the legs/pants are cut (as shown in FIG. 3B) and stitching (as shown in FIG. 3C) stitch from waist down the side DO NOT STITCH THE OPENING FOR THE FEET. At the bottom of each leg turn the material up and stitch evenly on both legs. Attach velcro per direction on package onto the leg of pants and the booties/feet to match.

FIG. D.1. top view of FIG. B.2.

Figure 4B:
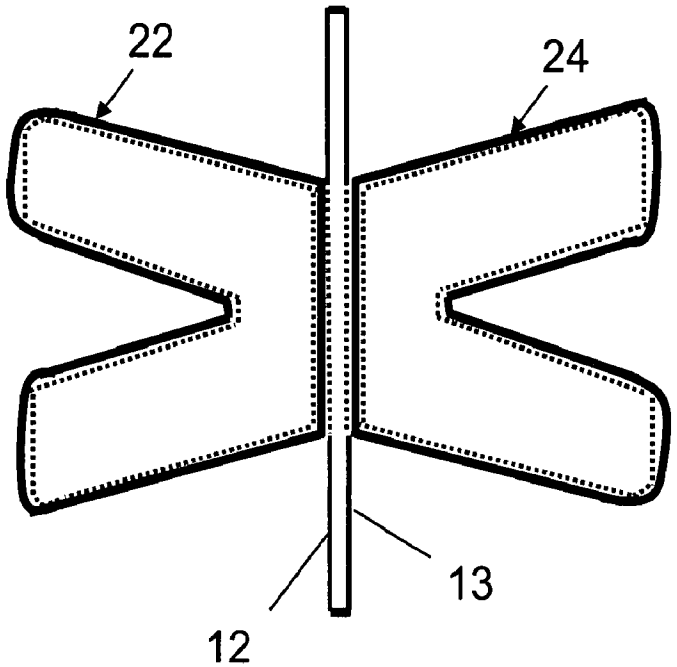
Figure 4A:
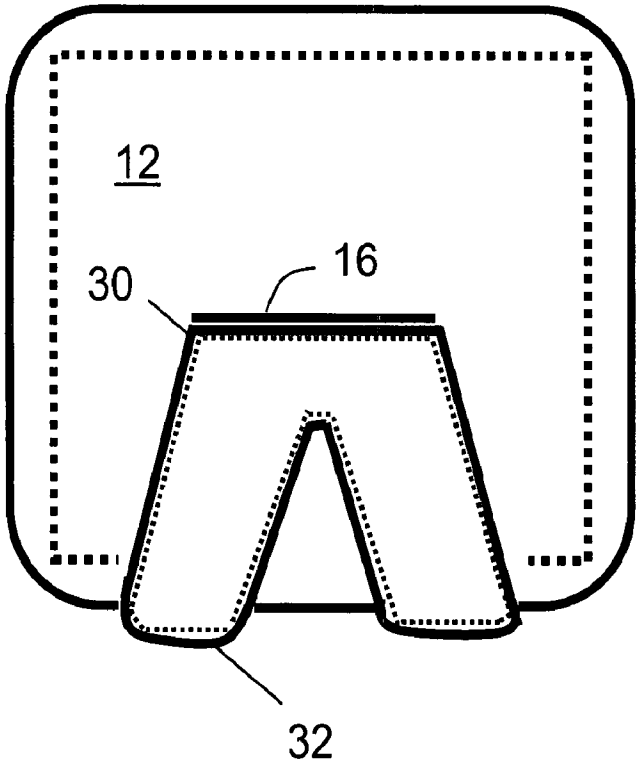

FIG. 4A shows both pairs of pants ready for attachment. Sewing one pair to each side of the blanket. Connecting/Sewing around the waist, but leaving a 2 to 3 in. opening (as shown FIG. 4A). in which to turn the entire blanket inside out ending with the right sides showing.

FIG. 4B is a side view of blanket with legs/pants attached with the wrong sides showing. *Note there is a 2 to 3 in. opening left.

Figure 5B:
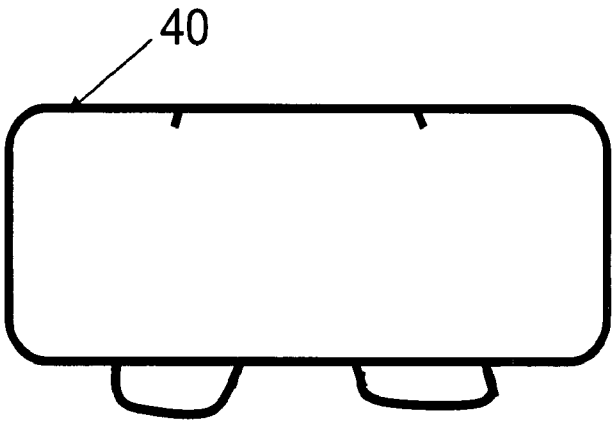
Figure 5A:
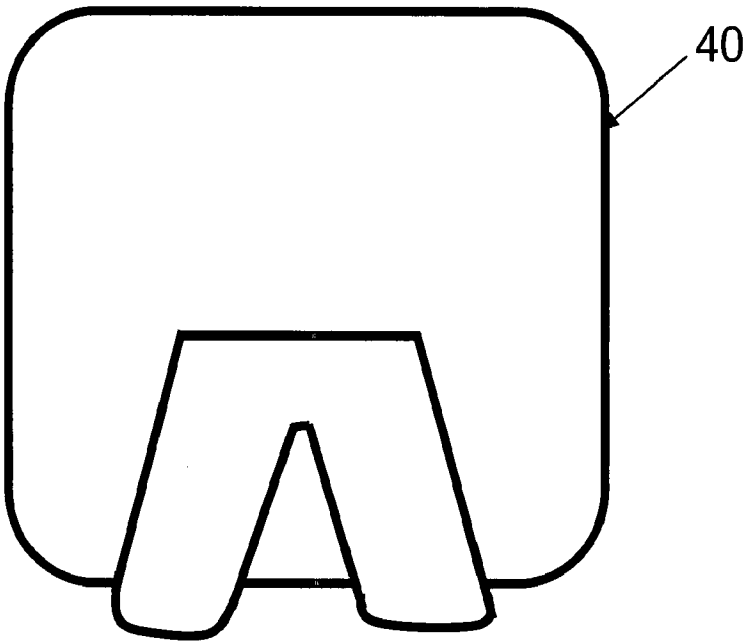

FIG. 5A bottom view of finished product turned to the right sides. Now fold seam and hand stitch the 2 to 3 in. opening tightly and snuggly very tight.

FIG. 5B side view of finished with blanket folded into half with the original opening now finished. Blanket can be decorated with anything that is safe for the infant, lace, pockets, etc.

DETAILED DESCRIPTION OF THE INVENTION

Figure 1A:
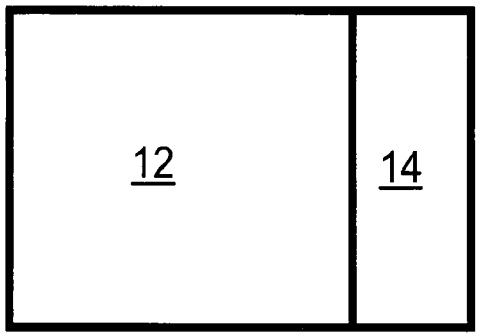
FIG. 1A. is top view of 2 pieces material with wrong sides showing, measuring 2½ yds by 60 wide/45 wide before being cut to 2 yds by 60 wide/45 wide. Keeping the right sides together throughout.
Figure 1B:
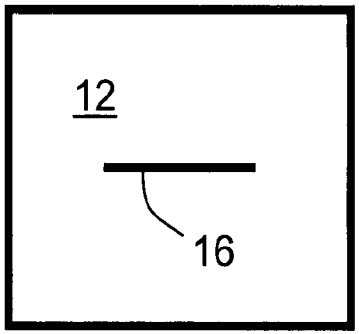
FIG. 1B is top view of 2 pieces material with wrong sides showing, measuring 2 yds by 60 wide/45 wide after being cut.
Figure 1C:
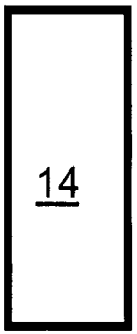
FIG. 1C is top view of 2 pieces material with wrong sides showing measuring ½ yds by 60 wide/45 wide. This will be used for legs/pants.

In FIG. 1A, two blanket panels of material are placed together prior to cutting. With both pieces of material still together, cut about 2 to 3 inches or less to produce a blanket portion 12 in FIG. 1B and a portion 14 to be used for pants in FIG. 1C. As shown in FIG. 1B, cut a slit 16 through both pieces keeping the right sides (what will become the outer sides of the blanket) together. Reserve the portion 14 to be used for pants as shown in FIG. 1C.

Figure 2A:
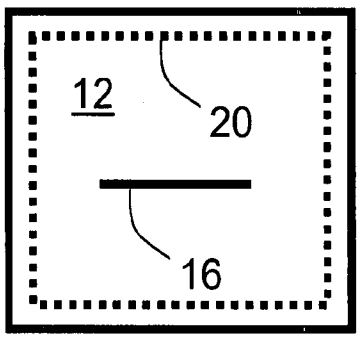
FIG. 2A is top view of FIG. 1A with right sides kept together and stitched completely from corner to corner (⅝ seam). Keep right sides together cut 2 to 3 in. or less slit (opening) in both pieces.
Figure 2B:
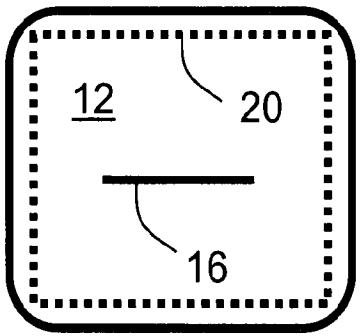
FIG. 2B is top view of FIG. 2A with corners trimmed of excess material (making sure not to cut into stitches).

As shown in FIG. 2A, keep the right sides together. Stitch completely around to form a square or circle with stitches 20. As shown in FIG. 2B, cutoff excess material on corner (making sure to not cut stitches 20).

Figure 3A:
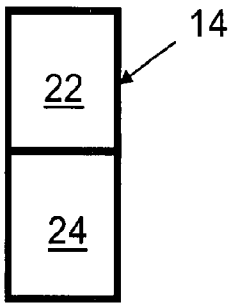
FIG. 3A. is top view of remaining 2 pieces ½ material which will fold in half and cut making 4 pieces of remaining material.
Figure 3B:
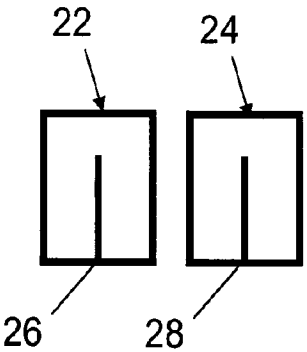
FIG. 3B is a top view of FIG. 3A cut into 4 pieces (you can either stack or cut individually as shown in FIG. 3B. Keeping right sides together cut legs by cutting 3 to 4 in from bottom middle making the slit and cut around to form legs.
Figure 3C:
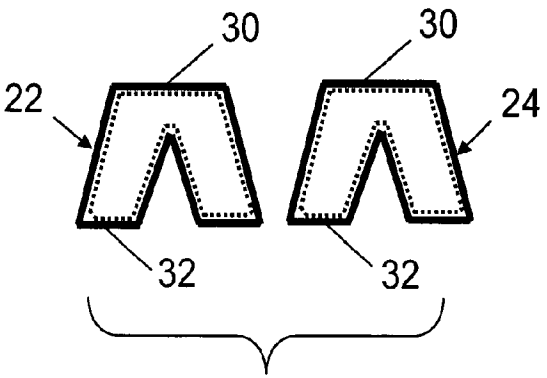
FIG. 3C top view of FIG. 3B after being stitched (this illustration is without detachable feet). Only stitched from top down the left of pants/legs around feet and up the pants/legs right side to the waist.
Figure 3D:
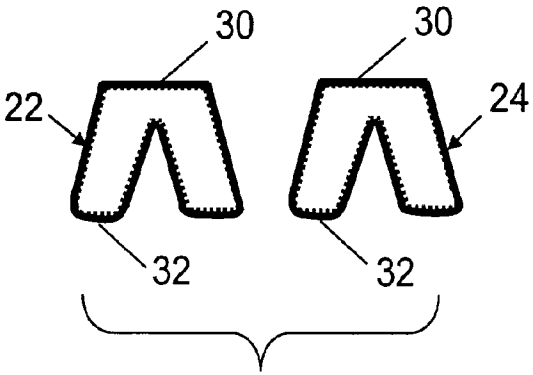
FIG. 3E is a top view of FIG. 3C after excess material has been removed (careful not to cut into stitches).

As shown in FIG. 3A, fold the portion 14 to be used for pants, keeping the right sides together and cut in half to provide the pants portions (22, 24) shown in FIG. 3B. Keeping the wrong side together, cut pant legs only ¾ of the way along pant slits (26, 28) to create a seat for the pants as shown in FIG. 3B. As shown in FIG. 3C, stitch around pants leaving the top/waist 30 of pants open. FIG. 3C also shows pant legs 32. Cut off excess material (making sure not to cut into stitching) to result in the two pairs of pants (22, 24) shown in FIG. 3D.

As shown in FIG. 4A, sew one pair of pants completely to the opening 16. Sew the second pair leaving enough opening to turn to the right side. Then, pull the blanket pants through the opening and hand stitch the opening. FIG. 4B is a sideview showing both pairs of pants (22, 24) attached at the opening in both blanket panels (12, 13).

As shown in FIGS. 5A and 5B is a finished reversible blanket with pants 40. Note that the blanket is reversible with two pairs of pants that can be pulled through the slit to either side and to make reversible. FIG. 5B shows the blanket folded over so that the baby can be dropped down into the pants. Note also that the stitching on the blanket is no longer visible from either outside side of the blanket as it now on the inside of the blanket since the blanket was pulled through the opening.

I claim:

1. A reversible blanket, comprising:

a first blanket panel forming a first side of the reversible blanket;

a second blanket panel forming a second side of the reversible blanket stitched to the first blanket panel;

a slit in each of the first and second blanket panels to form an opening;

a first pair of pants having a waist and two pant legs;

a second pair of pants having a waist and two pant legs;

the waist of each of the first pair of pants and the second pair of pants stitched to the blanket proximate the opening to allow each of the pairs of pants to be drawn through the opening to either side of the reversible blanket.

2. The reversible blanket of claim 1 wherein each of the pant legs are stitched closed.

3. A method of making a reversible blanket with attached pants, comprising:

stitching a first blanket panel to a second blanket panel right side in and wrong side out;

cutting a slit through the first blanket panel and the second blanket panel to form an opening;

attaching a first pair of pants having a waist and two pant legs to the first blanket panel at the opening;

partially attaching a second pair of pants having a waist and two pant legs to the second blanket panel to partially close proximate the opening;

drawing the blanket through the remaining opening such that the blanket becomes right side out and wrong side in;

finishing attachment of the second pair of pants to the opening to thereby close the opening; and pulling the first pair of pants into the second pair of pants to thereby provide the reversible blanket with attached pants.

4. The method of claim 3 further comprising pulling the second pair of pants into the first pair of pants to thereby reverse the blanket to be used.

* * * * *